US007661930B2

(12) United States Patent
Deschamps et al.

(10) Patent No.: US 7,661,930 B2
(45) Date of Patent: Feb. 16, 2010

(54) CENTRAL COOLING CIRCUIT FOR A MOVING BLADE OF A TURBOMACHINE

(75) Inventors: Pascal Deschamps, Bagneux (FR); Patrice Eneau, Moissy Cramayel (FR); Thomas Potier, Paris (FR)

(73) Assignee: Snecma, Paris (FR)

( * ) Notice: Subject to any disclaimer, the term of this patent is extended or adjusted under 35 U.S.C. 154(b) by 461 days.

(21) Appl. No.: 11/562,726

(22) Filed: Nov. 22, 2006

(65) Prior Publication Data

US 2007/0122282 A1 May 31, 2007

(30) Foreign Application Priority Data

Nov. 28, 2005 (FR) ..... 05 12003

(51) Int. Cl.
*F01D 5/18* (2006.01)

(52) U.S. Cl. ..... 416/97 R

(58) Field of Classification Search ..... 416/97 R
See application file for complete search history.

(56) References Cited

U.S. PATENT DOCUMENTS 5,165,852 A * 11/1992 Lee et al. ..... 416/97 R
5,356,265 A 10/1994 Kercher
7,513,739 B2 * 4/2009 Boury et al. ..... 416/97 R
2007/0059172 A1 * 3/2007 Lee et al. ..... 416/97 R
2007/0116570 A1 * 5/2007 Boury et al. ..... 416/97 R
2007/0253815 A1 * 11/2007 Kopmels et al. ..... 416/97 R

FOREIGN PATENT DOCUMENTS

EP 1 526 250 A2 4/2005
EP 1 584 790 A2 10/2005
JP 60-135606 7/1985
JP 60198305 A * 10/1985

* cited by examiner

*Primary Examiner*—Richard Edgar
(74) *Attorney, Agent, or Firm*—Oblon, Spivak, McClelland, Maier & Neustadt, L.L.P.

(57) ABSTRACT

A moving blade for a turbomachine with a central portion that is geometrically subdivided into four adjacent pressure-side zones disposed on the pressure side of the blade, and into four adjacent suction-side zones disposed on the suction side of the blade, the pressure-side and suction-side zones being distributed on either side of the skeleton of the blade, and the blade including in its central portion a pressure-side cooling circuit and a suction-side cooling circuit, the pressure-side cooling circuit including three radial cavities occupying three adjacent pressure-side zones, and the suction-side cooling circuit including three radial cavities occupying the four suction-side zones and the remaining pressure-side zone.

14 Claims, 4 Drawing Sheets

FIG.1
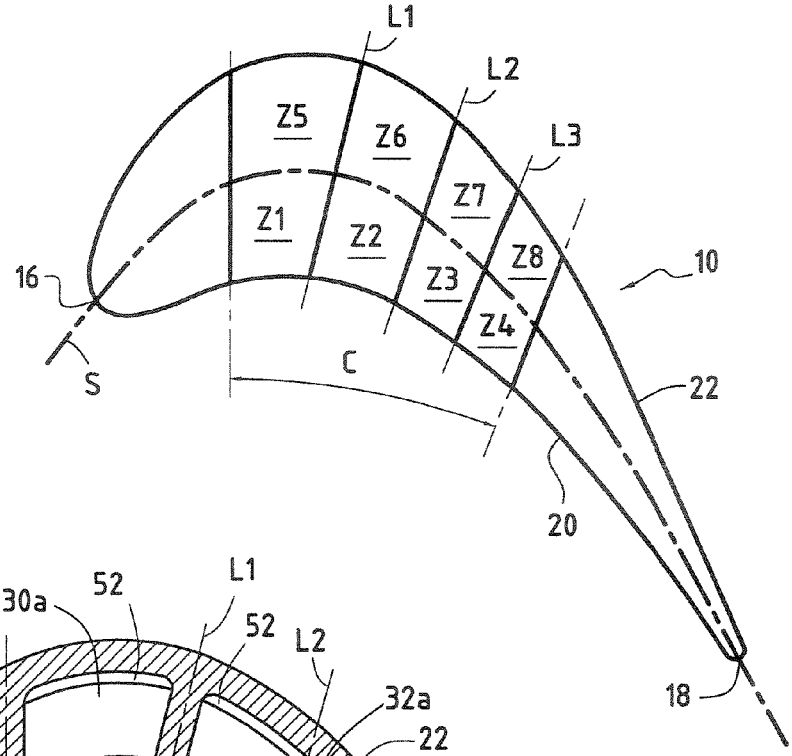
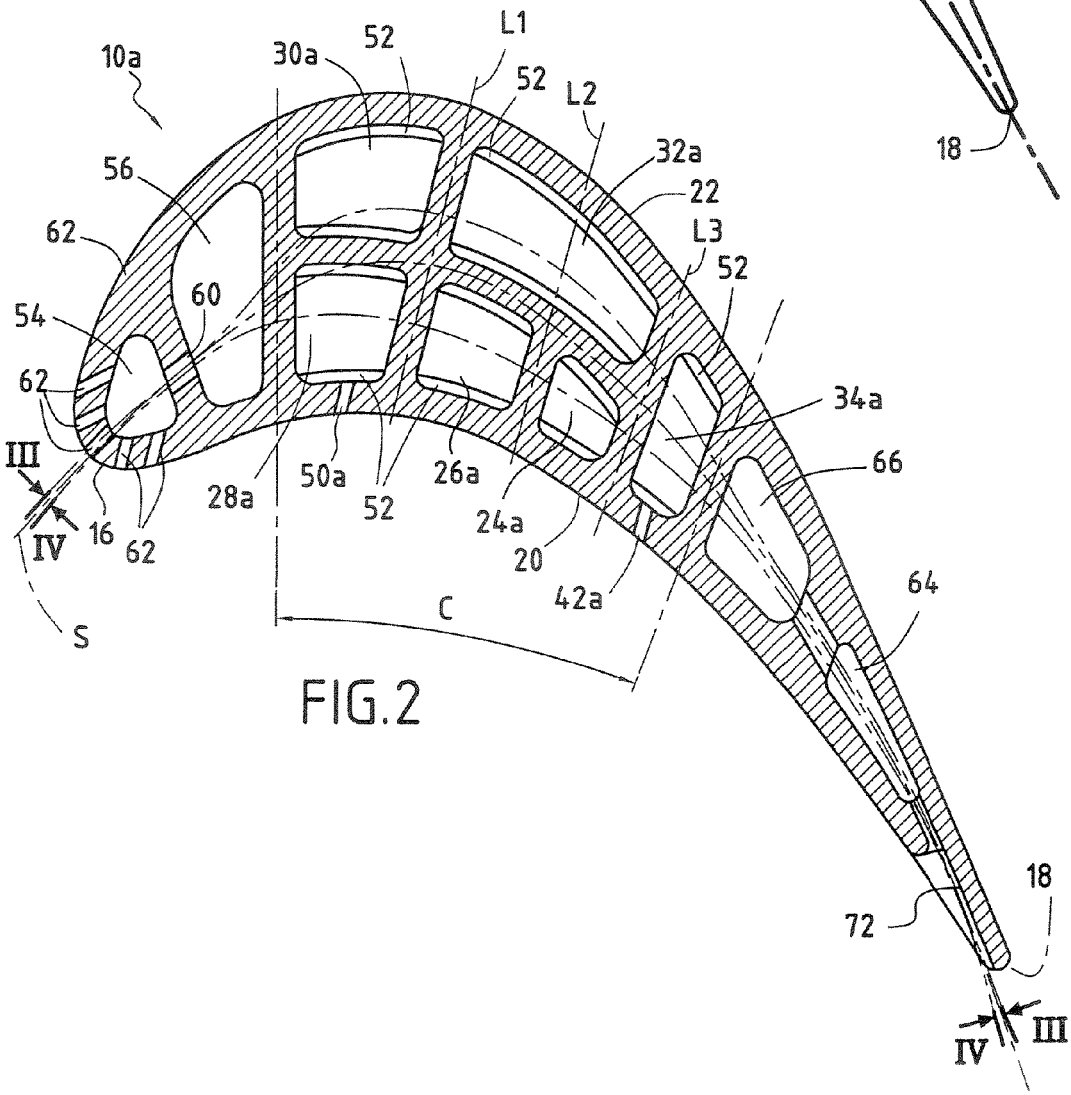
FIG.2

CENTRAL COOLING CIRCUIT FOR A MOVING BLADE OF A TURBOMACHINE

BACKGROUND OF THE INVENTION

The present invention relates to the general field of cooling moving blades for turbomachines, and in particular the blades of a high pressure turbine.

In a turbomachine, it is known to provide the moving blades of a gas turbine, such as the high pressure turbine or the low pressure turbine, with internal cooling circuits enabling them to withstand without damage the very high temperatures to which they are subjected while the turbomachine is in operation. Thus, in a high pressure turbine, the temperature of the gas coming from the combustion chamber can reach values that are well above those that can be withstood by the moving blades of the turbine without damage, thereby having the consequence of reducing their lifetime.

By means of such cooling circuits, air which is generally introduced into the blade via its root, travels through the blade following a path made up of cavities formed inside the blade, prior to being ejected through orifices that open out in the surface of the blade.

A wide variety of different configurations exist for such cooling circuits. Thus, certain circuits make use of cooling cavities that occupy the entire width of the blade, thereby presenting the drawback of limiting the thermal efficiency of the cooling. In order to mitigate that defect, other circuits, such as those described in patent documents EP 1 288 438 and EP 1 288 439, propose using edge cooling cavities occupying only one side of the blade (pressure side or suction side), or both sides with the addition of a large central cavity between the edge cavities. Although such circuits are effective from a thermal point of view, they remain difficult and expensive to produce by casting and the weight of the resulting blade is large.

OBJECT AND SUMMARY OF THE INVENTION

A main object of the present invention is thus to mitigate such drawbacks by proposing a central cooling circuit for a moving blade that makes it possible to obtain effective cooling of the blade at low manufacturing cost.

To this end, the invention provides a moving blade for a turbomachine, the central portion of the blade being geometrically subdivided into four adjacent pressure-side zones disposed on the pressure side of the blade, and into four adjacent suction-side zones disposed on the suction side, the pressure-side and suction-side zones being distributed on opposite sides of the skeleton of the blade, the blade including in its central portion both a pressure-side cooling circuit and a suction-side cooling circuit that are independent from each other, the pressure-side cooling circuit comprising three radial cavities occupying three adjacent pressure-side zones, and the suction-side cooling circuit comprising three radial cavities occupying the four suction-side zones and the remaining pressure-side zone.

The pressure-side and suction-side cooling circuits as defined above present a configuration that is asymmetrical between the pressure side and the suction side and they are specific to each of the walls (pressure-side wall, suction-side wall) of the blade. This makes it possible to take account of the heat exchange levels that are lower on the pressure side than on the suction side of the blade. This also makes it possible to take account of the effect of the Coriolis force which tends to "press" air against one of the walls of the blade depending on whether the flow is centripetal or centrifugal.

As a result, it is possible to obtain a blade for which weight, mean temperature, and lifetime are optimized for a manufacturing cost that is low.

In an embodiment of the invention, the suction-side cooling circuit may comprise a first cavity and a second cavity extending on the suction side of the blade; a third cavity extending from the pressure side to the suction side of the blade; an air admission opening at one radial end of the first cavity; a first passage causing the other radial end of the first cavity to communicate with an adjacent radial end of the second cavity; a second passage causing the other radial end of the second cavity to communicate with an adjacent radial end of the third cavity; and outlet orifices opening from the third cavity out into the pressure-side face of the blade.

The third cavity of such a suction-side cooling circuit may be disposed beside the leading edge or beside the trailing edge In another embodiment of the invention, the suction-side cooling circuit may comprise a first cavity and a second cavity extending on the suction side of the blade; a third cavity extending on the pressure side the blade; an air admission opening at one radial end of the first cavity; a first passage causing the other radial end of the first cavity to communicate with an adjacent radial end of the second cavity; a second passage causing the other radial end of the second cavity to communicate with an adjacent radial end of the third cavity; and outlet orifices opening from the third cavity out into the pressure-side face of the blade.

The third cavity of such a suction-side cooling circuit can be disposed beside the leading edge or beside the trailing edge of the blade.

In a particular disposition of the invention, the pressure-side cooling circuit may comprise first, second, and third cavities extending on the pressure side of the blade; an air admission opening at a radial end of the first cavity; a first passage causing the other radial end of the first cavity to communicate with an adjacent radial end of the second cavity; a second passage causing the other radial end of the second cavity to communicate with an adjacent radial end of the third cavity; and outlet orifices opening from the third cavity out into the pressure-side face of the blade.

The blade may also include a cooling circuit for the leading edge of the blade and a cooling circuit for the trailing edge of the blade.

The invention also provides a gas turbine including at least one moving blade as defined above.

The invention also provides a turbomachine including at least one moving blade as defined above.

BRIEF DESCRIPTION OF THE DRAWINGS

Other characteristics and advantages of the present invention appear from the following description made with reference to the accompanying drawings which show an embodiment having no limiting character. In the figures:

FIG. 1 is a cross-section view of a moving blade for a turbomachine showing the various geometrical zones in its central portion;

FIG. 2 is a cross-section view of a moving blade in one embodiment of the invention;

DETAILED DESCRIPTION OF EMBODIMENTS

FIG. 1 shows a moving blade 10 of a turbomachine such as a moving blade of a high pressure turbine. Naturally, the invention can also apply to other moving blades of a turbomachine, for example to the blades of its low pressure turbine.

Figure 3:
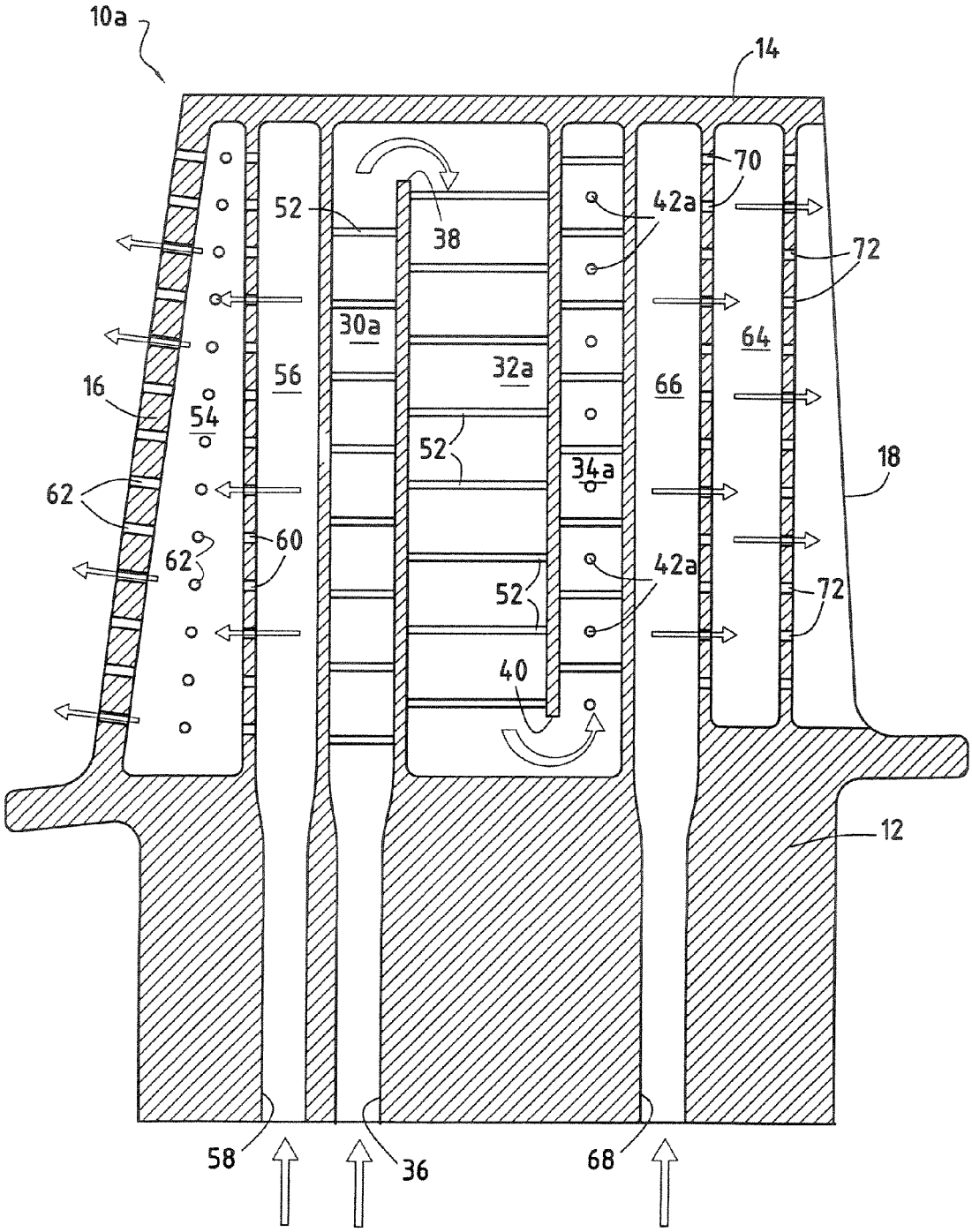
FIGS. 3 and 4 are section views of FIG. 2 respectively on III-III and on IV-IV.
Figure 4:
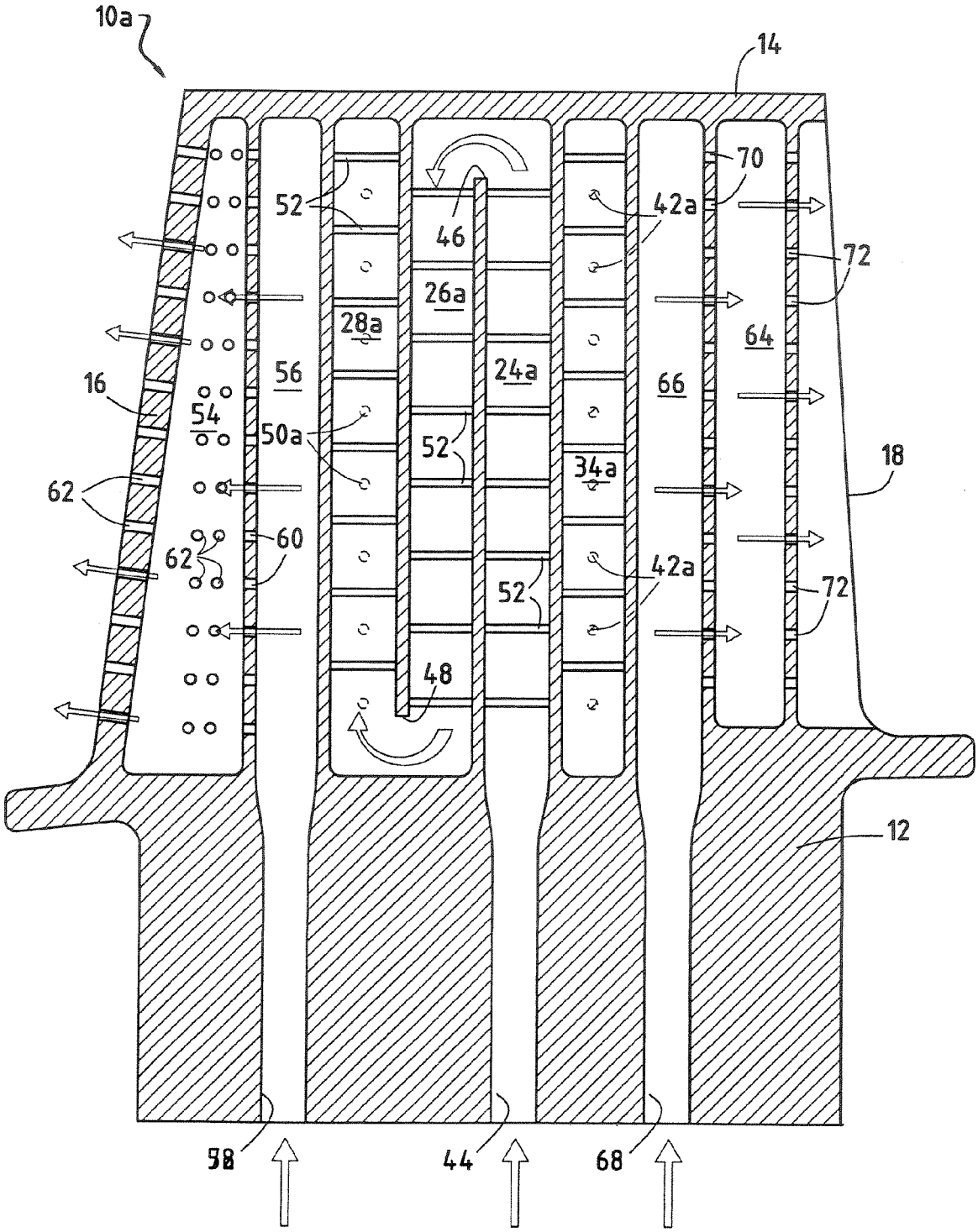

The blade 10 has an aerodynamic surface (or airfoil) that extends radially between a blade root 12 and a blade tip 14 (FIGS. 3 and 4). This aerodynamic surface is made up of a leading edge 16 placed facing the flow of hot gas coming from the combustion chamber of the turbomachine, a trailing edge 18 remote from the leading edge 16, a pressure-side face 20, and a suction-side face 22, these side faces 20 and 22 interconnecting the leading edge 16 and the trailing edge 18.

The blade 10 has a central portion C occupying the geometrical zone of the blade where the distance between its pressure-side and suction-side faces 20 and 22 is the greatest.

As shown in FIG. 1, the central portion C of the blade is geometrically subdivided into four adjacent pressure-side zones Z1 to Z4 on the pressure side of the blade, and four adjacent suction-side zones Z5 to Z8 disposed on the suction side, the pressure-side and suction-side zones being distributed on either side of the skeleton S of the blade.

When applied to a blade, the term "skeleton" is used to mean the geometrical line S of points that are situated at equal distances from the pressure-side and suction-side faces 20 and 22 of the blade.

More precisely, the skeleton S of the blade defines two main zones of the central portion C of the blade, each of which is subdivided into four adjacent zones by three geometrical lines L1 to L3 intersecting the blade radially in its thickness direction.

The pressure-side and suction-side geometrical zones Z1 to Z4 and Z5 to Z8 as defined in this way constitute the smallest elements that can contain a cooling cavity. For a conventional high pressure turbine blade, each of these zones occupies a cross-sectional area that lies typically in the range 3 square millimeters ($mm^2$) to 10 $mm^2$.

In the invention, the central portion C of the blade is provided with a pressure-side cooling circuit and with a suction-side cooling circuit, the pressure-side cooling circuit having three radial cavities occupying three adjacent pressure-side zones, and the suction-side cooling circuit having three radial cavities occupying the four suction-side zones and the remaining pressure-side zone.

The term "radial cavity" is used below in the description to designate a cavity that extends radially between the root 12 and the tip 14 of the blade.

Various embodiments of the pressure-side and suction-side cooling circuits of the blade can be envisaged.

In the embodiment of the invention shown in FIGS. 2 to 4, the pressure-side cooling circuit of the blade 10*a* comprises three radial cavities 24*a*, 26*a*, and 28*a* occupying three adjacent pressure-side zones Z3, Z2, and Z1 in FIG. 1.

The suction-side cooling circuit of the blade has three suction-side radial cavities 30*a*, 32*a*, and 34*a* occupying the four suction-side zones Z5 to Z8 and the remaining pressure-side zone Z4.

More precisely, the suction-side circuit of the blade comprises a first cavity 30*a* extending along the suction side of the blade and occupying suction-side zone Z5, a second cavity 32*a* extending on the suction side of the blade and occupying the suction-side zones Z6 and Z7, and a third cavity 34*a* extending between the pressure-side face 20 to the suction-side face 22 of the blade and occupying the suction-side zone Z8 and the pressure-side zone Z4.

When the cavity is said to extend from the suction side of the blade, it should be understood that the cavity extends across the thickness of the blade from the suction-side face 22 of the blade as far as its skeleton S.

The cavities 30*a* to 34*a* of the suction-side cooling circuit are cavities having cross-sections greater than about 4 $mm^2$.

Furthermore, the third cavity 34*a* of the suction-side circuit that extends from the pressure-side face 20 to the suction-side face 22 of the blade is located towards the trailing edge 18 of the blade.

With reference to FIG. 3, the suction-side cooling circuit also includes an air admission opening 36 at a radial end of the first cavity 30*a* (in this case level with the root 12 of the blade) for the purpose of feeding the suction-side circuit with air.

The first passage 38 causes the other radial end of the first cavity 30*a* (i.e. in the vicinity of the tip 14 of the blade) to communicate with an adjacent radial end of the second cavity 32*a*. Similarly, a second passage 40 causes the other radial end of the second cavity 32*a* to communicate with an adjacent radial end of the third cavity 34*a*.

In addition, outlet orifices 42*a* open from the third cavity 34*a* out into the pressure-side face 20 of the blade. These outlet orifices 42*a* are regularly distributed over the entire radial height of the blade.

The flow of cooling air that travels along the suction-side circuit can be understood in obvious manner from the above description. The circuit is fed with cooling air via the admission opening 36. The air begins by traveling along the first cavity 30*a* (in a centrifugal flow direction) and then along the suction-side cavity 32*a* (centripetal flow), and finally along the central cavity 34*a* (centrifugal flow) prior to being ejected into the pressure side 20 of the blade through the outlet orifices 42*a*.

The pressure-side cooling circuit of the blade comprises a first cavity 24*a* occupying pressure-side zone Z3, a second cavity 26*a* occupying pressure-side zone Z2, and a third cavity 28*a* occupying pressure-side zone Z1.

These cavities 24*a* to 28*a* extend on the pressure side of the blade, i.e. they extend in the thickness direction of the blade from the pressure-side face 20 of the blade as far as its skeleton S.

Furthermore, the cavities 24*a* to 28*a* are cavities having cross-sections of less than about 15 $mm^2$.

As shown in FIG. 4, the pressure-side cooling circuit also includes an air admission opening 44 at a radial end of the first cavity 24*a* (in this case level with the root 12 of the blade) for feeding the pressure-side circuit with air.

A first passage 46 causes the other radial end (at the tip 14 of the blade) of the first cavity 24*a* to communicate with an adjacent radial end of the second cavity 26*a*. Similarly, a second passage 48 causes the other radial end of the second cavity 26*a* to communicate with an adjacent radial end of the third cavity 28*a*. Outlet orifices 50*a* open from the third cavity 28*a* out into the pressure-side face 20 of the blade.

The flow of cooling air traveling along the pressure-side circuit can be understood in obvious manner from the above. The circuit is fed with cooling air via the admission opening 44. The air then flows along the first, second, and third cavities 24*a*, 26*a*, and 28*a* prior to being exhausted through the pressure-side 20 of the blade via the outlet orifices 50*a*.

In conventional manner, the inside walls of the cavities 24*a*, 26*a*, 28*a*, 30*a*, 32*a*, and 34*a* of the pressure-side and suction-side cooling circuits may advantageously be provided with flow disturbers 52 for increasing heat transfer along said walls.

These flow disturbers may be in the form of ribs that are straight or sloping relative to the axis of rotation of the blade, or they may be in the form of spikes (or they may have any other equivalent forms).

Figure 5:
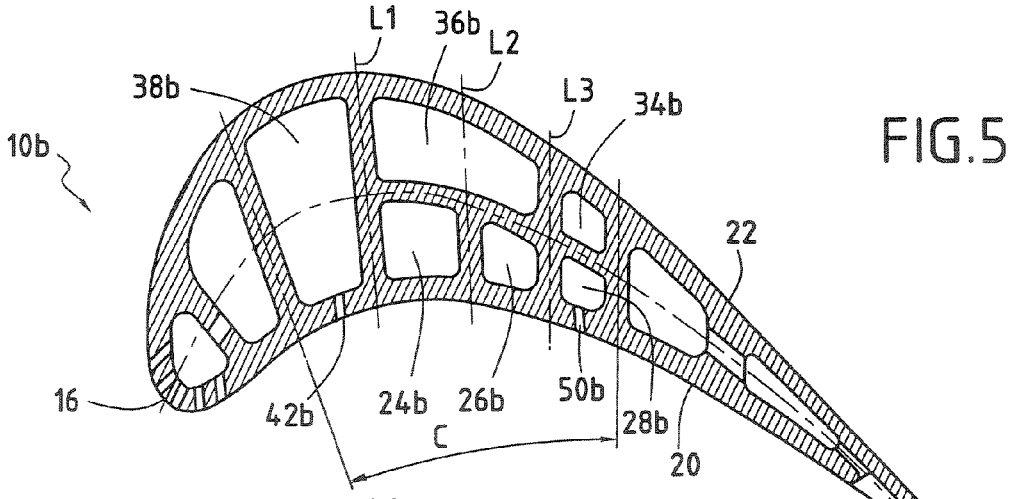
FIGS. 5 to 7 are cross-section views of moving blades in other embodiments of the invention.

FIG. 5 shows a variant embodiment of the pressure-side and suction-side cooling circuits of the blade.

The suction-side cooling circuit of the blade 10*b* in this embodiment comprises a first cavity 34*b* occupying suction-side zone Z8, a second cavity 36*b* occupying the suction-side zones Z6 and Z7, and a third cavity 38*b* occupying suction-side zone Z5 and pressure-side zone Z1.

In other words, compared with the embodiment of FIGS. 2 to 4, the suction-side circuit differs specifically in that the third cavity 38*b* is disposed towards the leading edge 16 of the blade (and not towards its trailing edge).

An air admission opening (not shown) is provided at one radial end (at the root of the blade) of the first cavity 34*b* and passages (not shown) provide communication between the various cavities 34*b*, 36*b*, and 38*b* in a configuration similar to that of the suction-side circuit of FIGS. 2 to 4. Outlet orifices 42*b* open from the third cavity 38*b* and open out into the pressure-side face 20 of the blade. The air flow direction in this suction-side circuit is thus opposite compared to that of the embodiment shown in FIGS. 2 to 4.

The pressure-side cooling circuit of the blade 10*b* in this embodiment has a first cavity 24*b* occupying pressure-side zone Z2, a second cavity 26*b* occupying pressure-side zone Z3, and a third cavity 28*b* occupying pressure-side zone Z4.

As in the preceding embodiment, an admission opening (not shown) is provided at a radial end (in the blade root) of the first cavity 24*b*, and passages (not shown) provide communication between the various cavities 24*b*, 26*b*, and 28*b* in a configuration similar to that of the pressure-side circuit of FIGS. 2 to 4. Outlet orifices 50*b* open from the third cavity 28*b* and open out into the pressure-side face 20 of the blade. The air flow direction in this pressure-side circuit is thus reversed compared with that of the embodiment shown in FIGS. 2 to 4.

Figure 6:
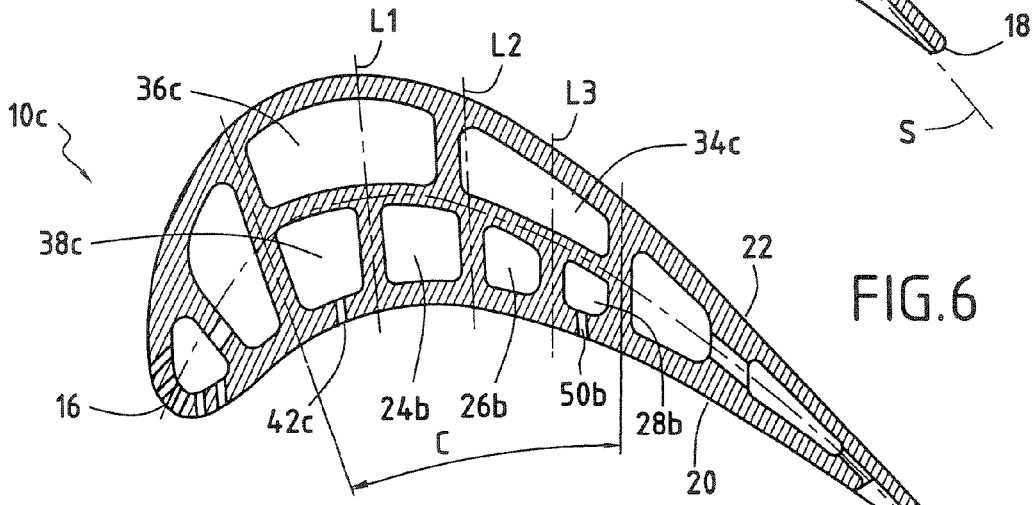

FIG. 6 shows another variant embodiment of pressure-side and suction-side cooling circuits of the blade.

The suction-side cooling circuit of the blade 10*c* in this embodiment has a first cavity 34*c* occupying suction-side zones Z7 and Z8, a second cavity 36*c* occupying suction-side zones Z5 and Z6, and a third cavity 38*c* occupying pressure-side zone Z1. The third cavity 38*c* of the suction-side cooling circuit is thus disposed beside the leading edge 16 of the blade.

In an embodiment similar to that of the suction-side circuit of FIGS. 2 to 4, cooling air is admitted into the first cavity 34*c* via an air admission opening (not shown) and passages (not shown) provide communication between the various cavities 34*c*, 36*c*, and 38*c*. Outlet orifices 42*c* open from the third cavity 38*c* out into the pressure-side face 20 of the blade.

The pressure-side cooling circuit is identical to that described above with reference to FIG. 5.

Figure 7:
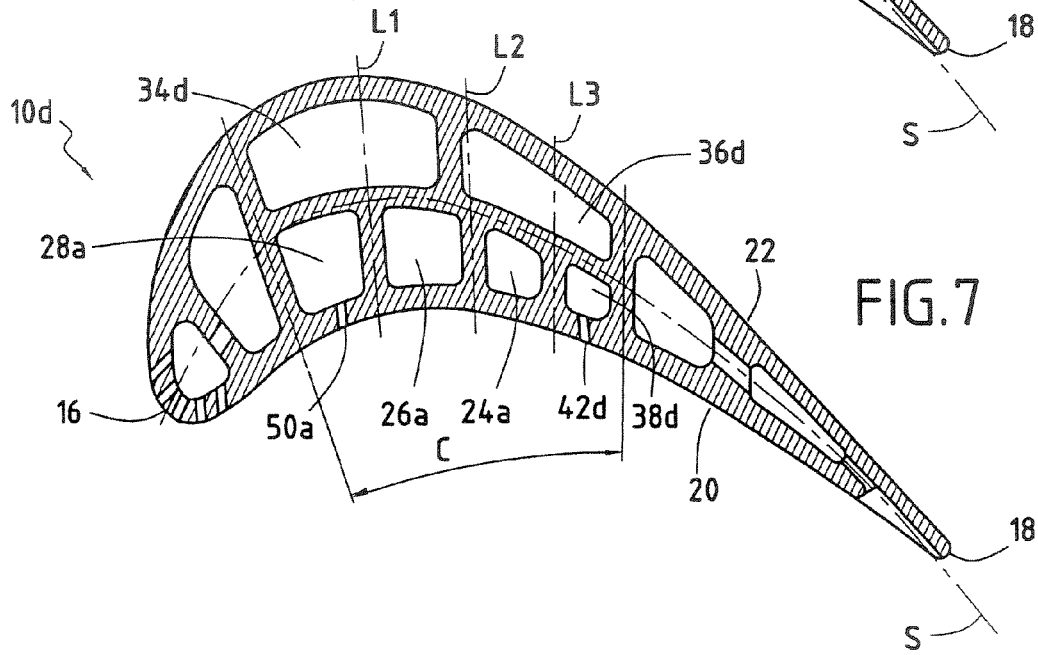

FIG. 7 shows yet another variant embodiment of the pressure-side and suction-side cooling circuits of the blade.

The suction-side cooling circuit of the blade 10*d* in this embodiment has a first cavity 34*d* occupying suction-side zones Z5 and Z6, a second cavity 36*d* occupying suction-side zones Z7 and Z8, and a third cavity 38*d* occupying pressure-side zone Z4.

Compared with the embodiment of the suction-side cooling circuit shown in FIG. 6, the third cavity 38*d* of this suction-side circuit is disposed beside the trailing edge 18 of the blade (instead of beside the leading edge).

Cooling air is admitted into the first cavity 34*d* via an air admission opening (not shown), and passages (not shown) provide communication between the various cavities 34*d*, 36*d*, and 38*d* in an embodiment similar to that of the suction-side circuit of FIGS. 2 to 4. Outlet orifices 42*d* open from the third cavity 38*d* and open out into the pressure-side face 20 of the blade. The air flow direction in this suction-side circuit is thus reversed relative to that of the embodiment of FIG. 6.

The pressure-side cooling circuit is identical in its configuration to that described with reference to FIGS. 2 to 4.

Whatever the embodiment, it should be observed that the pressure-side and suction-side cooling circuits present their own respective air admission opening and there is no air communication from one circuit to the other such that the circuits are completely independent from each other.

With reference to FIGS. 2 to 4, there follows a brief description of an embodiment of additional cooling circuits for cooling the leading edge 16 and the trailing edge 18 of the blade.

The cooling circuit for the leading edge of the blade comprises a first radial cavity 54 extending in the vicinity of the leading edge 16 of the blade and a second radial cavity 56 extending from the pressure-side face 20 to the suction-side face 22 of the blade, said second cavity 56 being disposed between the first cavity 54 and the central portion C of the blade.

At least one air admission orifice 58 opens into the second cavity 56 so as to feed the leading edge circuit with air. A plurality of communication holes 60 distributed over the entire radial height of the blade open from the second cavity 56 out into the first cavity 54. Finally, outlet orifices 62 open from the first cavity 54 out into the leading edge 16 and into the pressure-side and suction-side faces 20 and 22 of the blade.

The cooling circuit for the trailing edge of the blade comprises a first radial cavity 64 extending in the vicinity of the trailing edge 18 of the blade, and a second radial cavity 66 extending from the pressure-side face 20 to the suction-side face 22 of the blade, said second cavity 66 being disposed between the first cavity 64 and the central portion C of the blade.

At least one air admission orifice 68 opens out from the second cavity 66 to feed the trailing edge circuit with air. A plurality of communication holes 70 distributed along the radial height of the blade open from the second cavity 66 out into the first cavity 64. In addition, outlet orifices 72 open from the first cavity 64 out into the pressure-side face 20 of the blade, in the vicinity of the trailing edge 18.

What is claimed is:

1. A moving blade for a turbomachine, the central portion of the blade being geometrically subdivided into four adjacent pressure-side zones disposed on the pressure side of the blade, and into four adjacent suction-side zones disposed on the suction side, the pressure-side and suction-side zones being distributed on opposite sides of the skeleton of the blade, the blade including in its central portion both a pressure-side cooling circuit and a suction-side cooling circuit that are independent from each other, the pressure-side cooling circuit comprising three radial cavities occupying three adjacent pressure-side zones, and the suction-side cooling circuit comprising three radial cavities occupying the four suctionside zones and the remaining pressure-side zone, wherein the blade further includes a trailing edge cooling circuit that is independent from the pressure-side and suction-side cooling circuits and that comprises at least one radial cavity in the vicinity of the trailing edge of the blade, at least one air admission orifice opening into the cavity of the trailing edge cooling circuit, and outlet orifices opening out into the trailing edge of the blade.

2. A blade according to claim 1, in which the suction-side cooling circuit comprises:

a first cavity and a second cavity extending on the suction side of the blade;

a third cavity extending from the pressure side to the suction side of the blade;

an air admission opening at one radial end of the first cavity;

a first passage causing the other radial end of the first cavity to communicate with an adjacent radial end of the second cavity;

a second passage causing the other radial end of the second cavity to communicate with an adjacent radial end of the third cavity; and outlet orifices opening from the third cavity out into the pressure-side face of the blade.

3. A blade according to claim 2, in which the third cavity of the suction-side cooling circuit is disposed beside the trailing edge of the blade.

4. A blade according to claim 2, in which the third cavity of the suction-side cooling circuit is disposed beside the leading edge of the blade.

5. A blade according to claim 1, in which the suction-side cooling circuit comprises:

a first cavity and a second cavity extending on the suction side of the blade;

a third cavity extending on the pressure side of the blade;

an air admission opening at one radial end of the first cavity;

a first passage causing the other radial end of the first cavity to communicate with an adjacent radial end of the second cavity;

a second passage causing the other radial end of the second cavity to communicate with an adjacent radial end of the third cavity; and outlet orifices opening from the third cavity out into the pressure-side face of the blade.

6. A blade according to claim 5, in which the third cavity of the suction-side cooling circuit is disposed beside the leading edge of the blade.

7. A blade according to claim 5, in which the third cavity of the suction-side cooling circuit is disposed beside the trailing edge of the blade.

8. A blade according to claim 1, in which the pressure-side cooling circuit comprises:

first, second, and third cavities extending on the pressure side of the blade;

an air admission opening at a radial end of the first cavity;

a first passage causing the other radial end of the first cavity to communicate with an adjacent radial end of the second cavity;

a second passage causing the other radial end of the second cavity to communicate with an adjacent radial end of the third cavity; and outlet orifices opening from the third cavity out into the pressure-side face of the blade.

9. A blade according to claim 1, further including a leading edge cooling circuit comprising:

a first radial cavity extending in the vicinity of the leading edge of the blade;

a second radial cavity extending from the pressure side to the suction side of the blade, said second cavity being disposed between the first cavity and the central portion of the blade;

an air admission opening opening into the second cavity;

a plurality of communication holes distributed over the entire radial height of the blade, opening from the second cavity out into the first cavity; and outlet orifices opening from said first cavity out into the leading edge and into the pressure-side and suction-side faces of the blade.

10. A blade according to claim 1, wherein said trailing edge cooling circuit comprises:

a first radial cavity extending in the vicinity of the trailing edge of the blade;

a second radial cavity extending from the pressure side to the suction side of the blade, said second cavity being disposed between the first cavity and the central portion of the blade;

at least one air admission orifice opening into the second cavity;

a plurality of communication holes distributed over the radial height of the blade opening from the second cavity out into the first cavity; and outlet orifices opening from said first cavity out into the trailing edge of the blade.

11. A gas turbine, including at least one moving blade according to claim 1.

12. A turbomachine, including at least one moving blade according to claim 1.

13. A blade according to claim 1, wherein the three cavities of the pressure-side cooling circuit extend in the thickness direction of the blade from its pressure-side face to its skeleton only.

14. A blade according to claim 1, wherein one of the three cavities of the suction-side cooling circuit is disposed beside the leading edge of the blade.

* * * * *